US007726042B2

(12) United States Patent
Meschan

(10) Patent No.: US 7,726,042 B2
(45) Date of Patent: Jun. 1, 2010

(54) ATHLETIC SHOE WITH REMOVABLE RESILIENT ELEMENT

(76) Inventor: David F. Meschan, 2205 New Garden Rd., #3301, Greensboro, NC (US) 27410

( * ) Notice: Subject to any disclaimer, the term of this patent is extended or adjusted under 35 U.S.C. 154(b) by 760 days.

(21) Appl. No.: 11/387,598

(22) Filed: Mar. 23, 2006

(65) Prior Publication Data

US 2006/0213082 A1 Sep. 28, 2006

Related U.S. Application Data

(60) Provisional application No. 60/664,469, filed on Mar. 23, 2005.

(51) Int. Cl.
*A43B 13/28* (2006.01)
*A43B 21/24* (2006.01)

(52) U.S. Cl. ..... 36/27; 36/35 R

(58) Field of Classification Search ..... 36/27, 36/28, 38, 7.8
See application file for complete search history.

(56) References Cited

U.S. PATENT DOCUMENTS

| | | | | |
|---|---|---|---|---|
| 2,104,924 | A * | 1/1938 | Dellea | 36/38 |
| 4,030,213 | A | 6/1977 | Daswick | |
| 4,267,648 | A | 5/1981 | Weisz | |
| 4,715,130 | A | 12/1987 | Scatena | |
| 5,042,175 | A | 8/1991 | Ronen et al. | |
| 5,068,981 | A | 12/1991 | Jung | |
| 5,285,584 | A * | 2/1994 | Dubner | 36/88 |
| 5,406,719 | A | 4/1995 | Potter | |
| 5,513,448 | A | 5/1996 | Lyons | |
| 6,282,814 | B1 | 9/2001 | Krafsur et al. | |
| 6,393,731 | B1 * | 5/2002 | Moua et al. | 36/27 |
| 6,423,021 | B1 | 7/2002 | Gallegos | |
| 6,665,957 | B2 | 12/2003 | Levert et al. | |
| 6,792,700 | B2 | 9/2004 | Gallegos | |
| 6,829,848 | B2 | 12/2004 | Gallegos | |
| 6,886,274 | B2 | 5/2005 | Krafsur et al. | |
| 7,228,648 | B2 * | 6/2007 | Yang | 36/35 R |
| D552,334 | S | 10/2007 | Lee | |
| 2003/0126760 | A1 | 7/2003 | LeVert et al. | |
| 2007/0180733 | A1 | 8/2007 | Lee | |

* cited by examiner

*Primary Examiner*—Ted Kavanaugh
(74) *Attorney, Agent, or Firm*—Martin & Ferraro, LLP

(57) ABSTRACT

An athletic shoe is provided with a selectively adjustable shock-absorbing element. In one preferred aspect, a plate is provided with a plurality of independently moveable portions in contact with the shock-absorbing element. In another aspect, a plate is provided at an angle relative to a coil spring. A method is provided for adjusting a shock-absorbing spring.

36 Claims, 8 Drawing Sheets

ATHLETIC SHOE WITH REMOVABLE RESILIENT ELEMENT

The present application claims the benefit of Provisional Application No. 60/664,469, filed Mar. 23, 2005, the disclosure of which is incorporated herein by reference.

BACKGROUND OF THE INVENTION

1. Field of the Invention

The present invention generally relates to a shoe, preferably an athletic shoe, with a shock-absorbing element in a midsole, preferably in the rear sole.

2. Description of the Prior Art

There are a number of shoes known in the prior art that incorporate springs as a shock-absorber. U.S. Pat. No. 4,267,648 to Weisz and U.S. Pat. No. 5,042,175 to Ronen et al., the disclosures of which are incorporated by reference herein, disclose a plurality of springs throughout the midsole. The Ronen patent discloses the midsole cushion containing springs that are removable from the side of the shoe. The shoes disclosed by the Weisz and Ronen patents are not optimally configured for lateral stability.

U.S. Pat. No. 5,406,719 to Potter, the disclosure of which is incorporated by reference herein, discloses a cushioning element which is adjustable. Such cushioning element utilizes a fluid flow system of chambers to control the cushioning of the shoe. Drawbacks of such a system include possible leaks, difficulty of replacement, and less than optimal stability.

While the shock-absorbing systems described above exhibit satisfactory shock absorbing characteristics, there exists a need for an improved shock-absorbing element that provides comparable to superior shock-absorbing qualities with greater stability, easier and more precise adjustability, and/or replaceability if that is a desired feature.

SUMMARY OF THE INVENTION

The present invention in one preferred embodiment includes a shoe having an upper and a bottom surface. At least a portion of the bottom surface is ground-engaging. The shoe further includes a spring. The spring has a vertical mid-longitudinal axis. At least a portion of the spring is between the upper and the bottom surface. The shoe further includes a platform adapted to move the spring into a plurality of positions along the vertical mid-longitudinal axis of the spring to adjust the amount of shock absorbed by the spring.

In another preferred embodiment, the present invention includes a shoe having an upper and a bottom surface. At least a portion of the bottom surface is ground-engaging. The shoe further includes a shock-absorbing element having a vertical mid-longitudinal axis, and a plate having a plurality of portions that are independently moveable relative to one another, at least two of the portions being operably connected with the shock-absorbing element.

In a further preferred embodiment, the present invention includes a shoe having an upper and a bottom. At least a portion of the bottom is ground-engaging. The shoe further includes a coil spring having an upper portion, a lower portion, and a mid-longitudinal axis. The mid-longitudinal axis of the coil spring is oriented generally in a perpendicular direction to the bottom of the shoe. The shoe further includes a plate having a generally planar portion below the upper and in contact with the upper portion of the coil spring, at least a portion of the plate being oriented at an angle (or in another embodiment, perpendicular) to the mid-longitudinal axis of the coil spring.

In another further preferred embodiment, the present invention includes a method for selectively adjusting the shock-absorbency of a portion of the midsole of a shoe. The method includes providing the shoe with a shock-absorbing spring compressible and decompressible into a plurality of positions along a vertical mid-longitudinal axis of the spring to adjust the amount of shock absorbed by the shock-absorbing spring without removing the shock-absorbing spring from the shoe and without substantially rotating the shock-absorbing spring. The method may also include a device for removing shock-absorbing spring from the shoe either from beneath the shoe or, in another preferred embodiment, from above the shoe.

DETAILED DESCRIPTION OF THE PREFERRED EMBODIMENT

Reference will now be made in detail to the present preferred embodiments of the invention, examples of which are illustrated in the accompanying drawings.

FIGS. 1 to 5 illustrate a shoe having a configuration of a shock-absorbing system in accordance with one preferred embodiment of the present invention. Although the shock-absorbing element of the present invention could be incorporated into the midsole of any type of shoe, it is envisioned that the primary beneficiary would be an athletic shoe.

Figure 1:
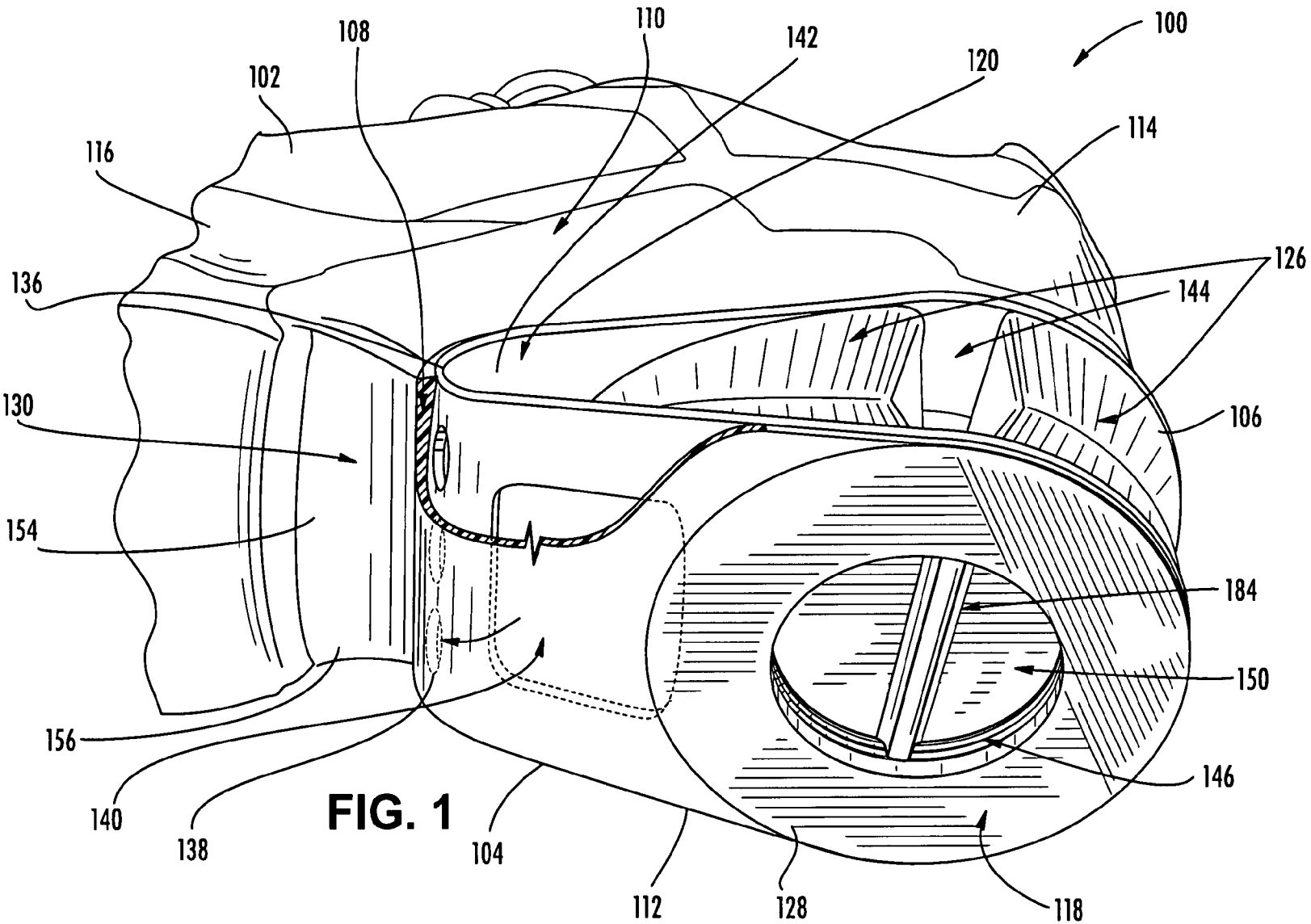
FIG. 1 is a partial bottom perspective view of the rear sole of a shoe in accordance with one preferred embodiment of the present invention.
Figure 2:
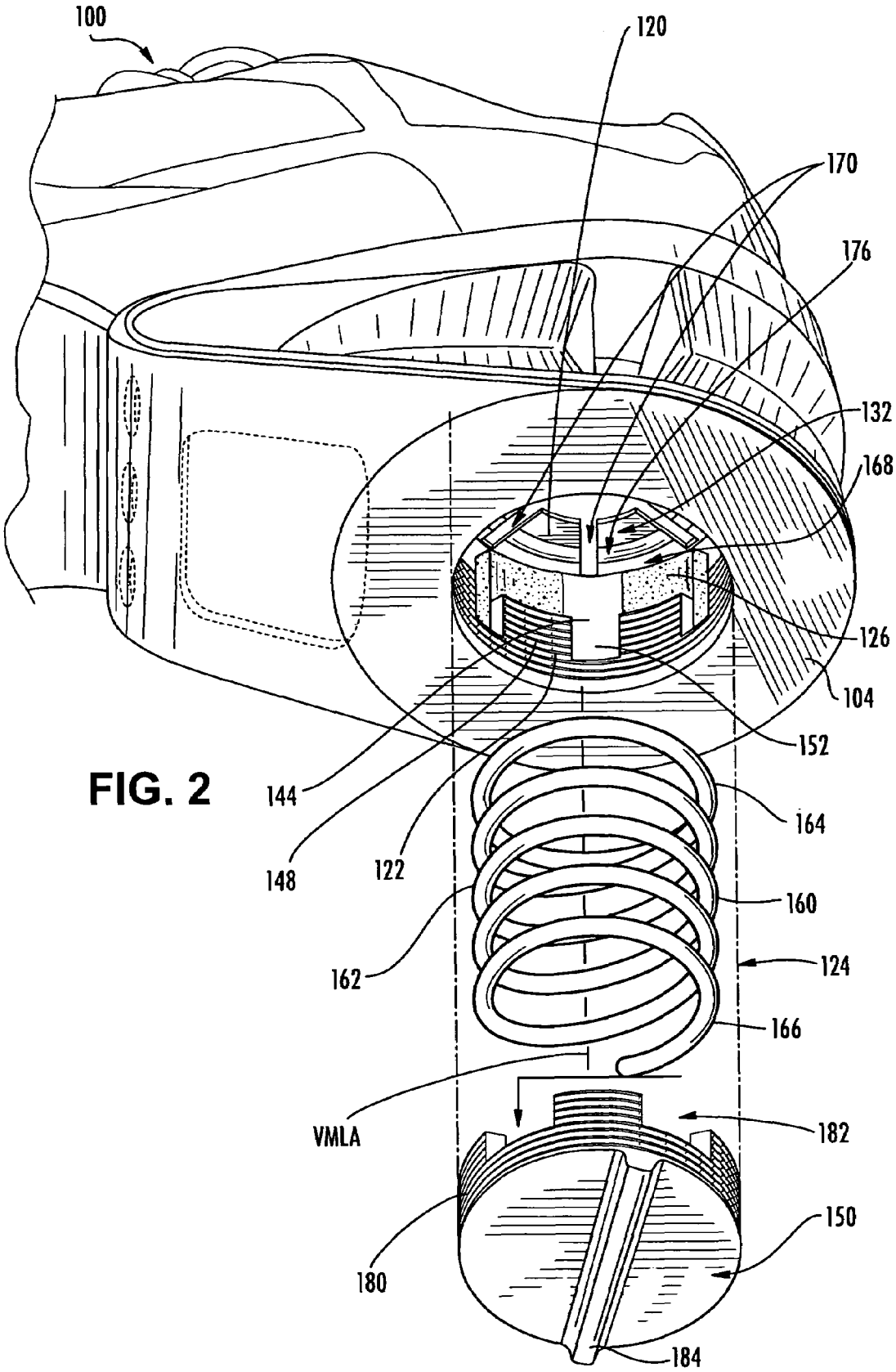
FIG. 2 is an exploded view of the rear sole of FIG. 1 showing a shock-absorbing element disengaged from the shoe.

FIGS. 1 and 2 show a shoe 100 including an upper 102, a bottom 104, a midsole 106, an outsole 108, a medial side 110, and a lateral side 112. Upper 102 includes a heel region 114, an arch region 116, and a forward portion (not shown). Located substantially below heel region 114 is a rear sole 118.

Rear sole 118 includes a plate 120, a bore 122 sized and configured to receive a shock-absorbing element 124, and a plurality of stiffening members 126 dispersed around the sides and the rear of the shoe. The interaction between plate 120 and shock-absorbing element 124 in rear sole 118 will be described in more detail below.

As shown in FIG. 1, outsole 108 preferably includes a ground-engaging portion 128 at the bottom of rear sole 118 and a non-ground-engaging portion 130 under arch region 116. Outsole 108 is preferably attached by glue or other adhesive to plate 120. It will be appreciated that portions of plate 120 may be exposed to view from outside the shoe, from a lateral side of the shoe, a medial side of the shoe, or a rear of the shoe. Portions of the plate may also be exposed to view from outside the shoe through outsole 108 if desired.

Figure 3A:
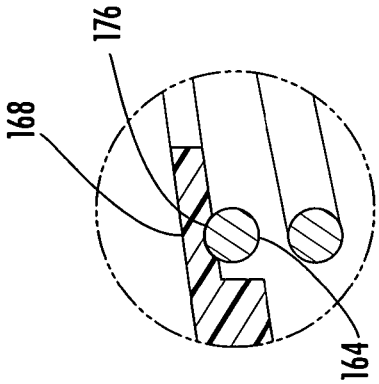
FIG. 3A is an enlarged view along line 3A of FIG. 3 showing the engagement of the shock-absorbing element with a plate in the shoe.
Figure 3:
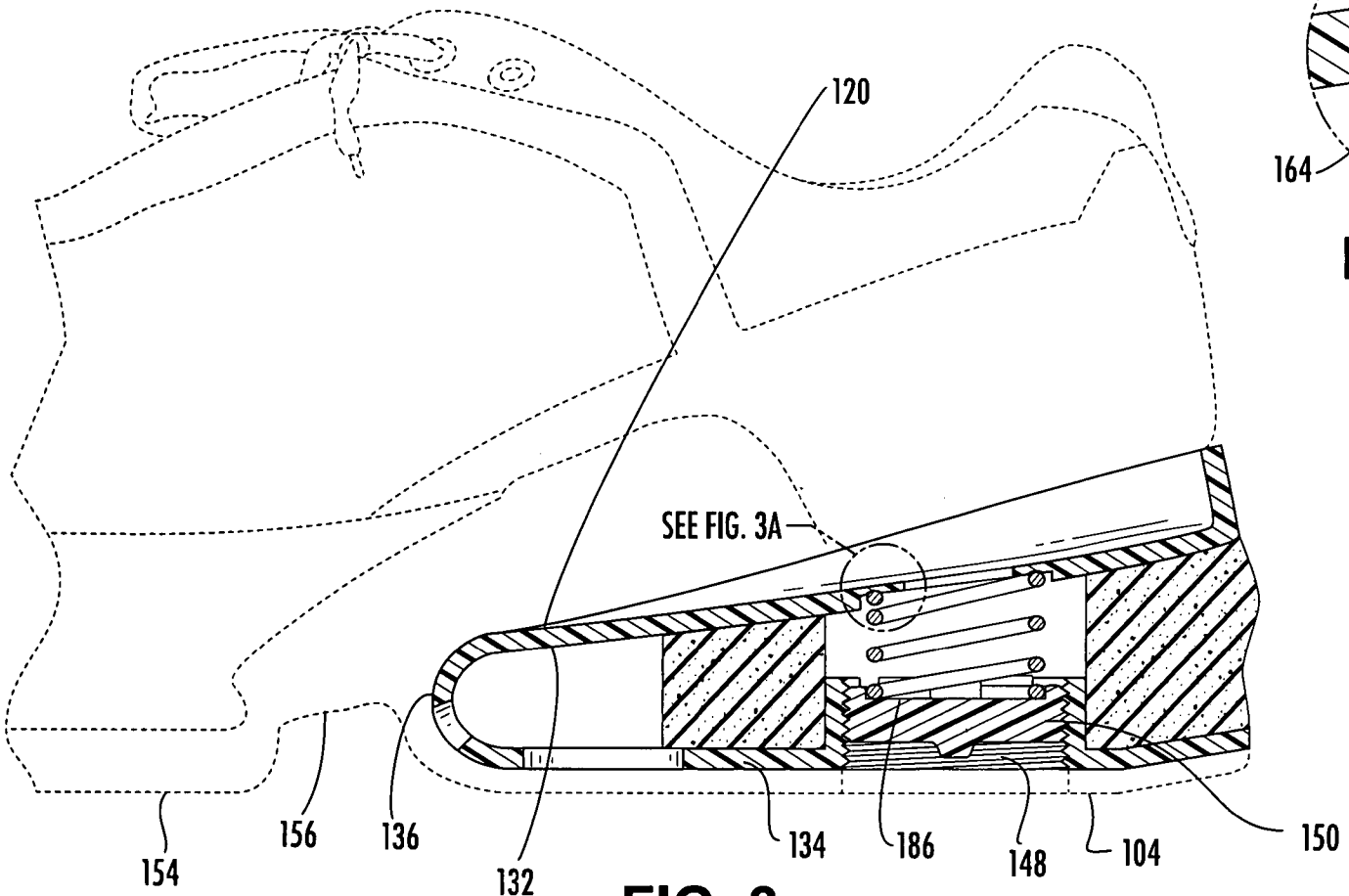
FIG. 3 is a partial side cross sectional view of the rear sole of FIG. 1 with the shock-absorbing element engaged in the rear sole in a relatively uncompressed position.
Figure 4:
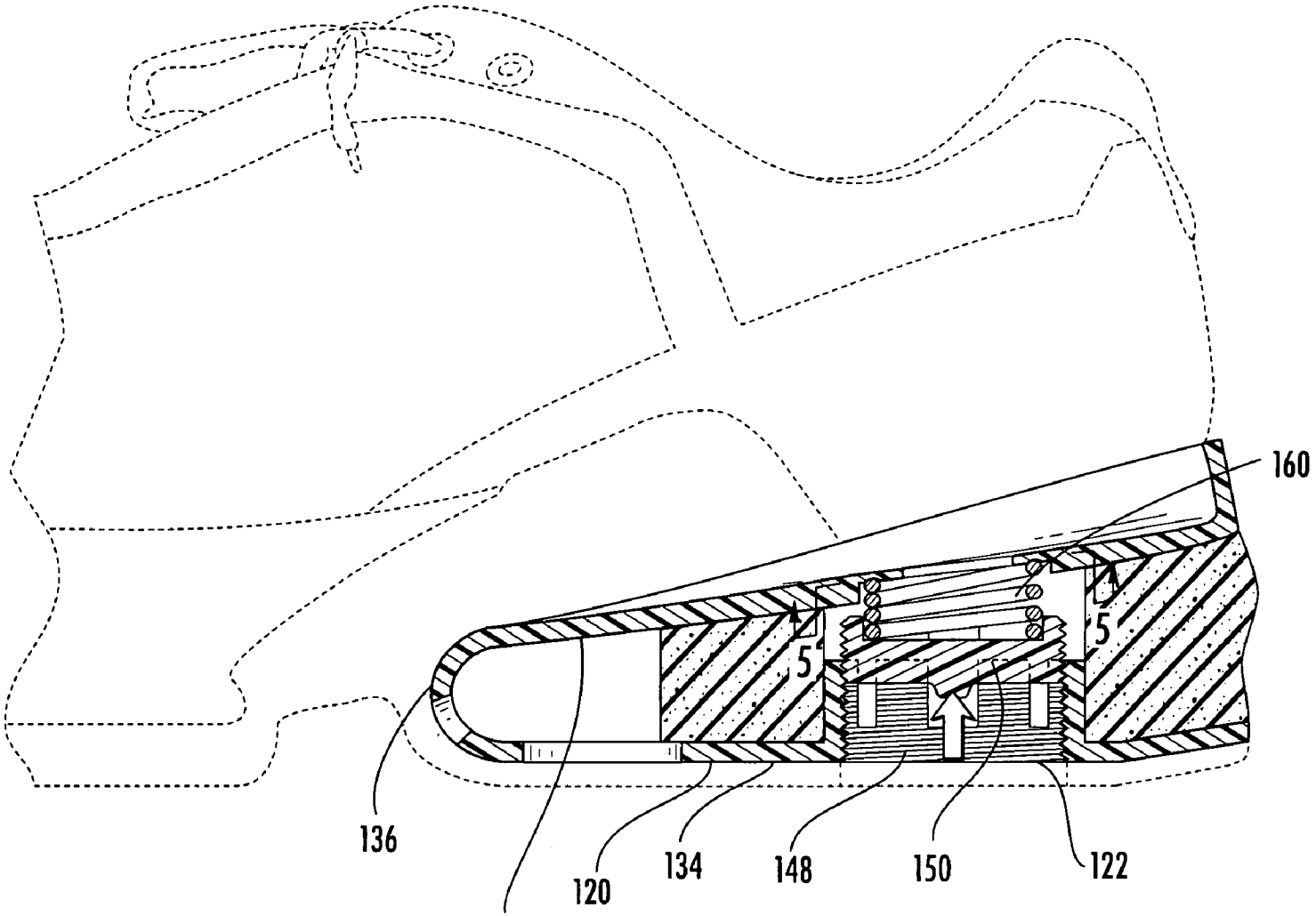
FIG. 4 is a partial side cross sectional view of the rear sole of FIG. 1 with the shock-absorbing element in a compressed position.

Referring to FIGS. 3 and 4, plate 120 preferably has an upper wall 132, a lower wall 134, and a curved wall 136 connecting upper wall 132 and lower wall 134. Upper wall 132, lower wall 134 and curved wall 136 generally form a U-shape. The U-shape of the plate contributes to the cushioning of the shoe to absorb shock. Examples of U-shaped plates are disclosed in U.S. Pat. No. 5,806,210 to Meschan, which patent is incorporated herein by reference in its entirety. It will be appreciated that rear sole 118 may include other plate configurations without departing from the scope of the present invention. Examples of other plate configurations are disclosed in U.S. Pat. No. 5,918,384 to Meschan, which patent is incorporated herein by reference in its entirety.

As shown in FIG. 3, lower wall 134 is preferably generally parallel with bottom 104 of the shoe. Upper wall 132 is shown in FIG. 3 at an angle relative to lower wall 134. It will be appreciated that upper wall 132 and lower wall 134 may be parallel to one another along the length of the shoe if so desired.

Plate 120 may include a plurality of openings for added flexibility and to reduce the amount of material and cost needed to manufacture the plate as well as to reduce the overall weight of the shoe. For example, as shown in FIG. 1, curved wall 136 may include a plurality of openings 138. Lower wall 134 may include an opening 140, which may have a dimension greater than one-half the width of lower wall 134.

As shown in FIG. 1, the interior of plate 120 may be in air communication with the outside of the shoe through openings 142 in medial side 110 and the lateral side (not shown), and through channels 144 between stiffening members 126.

Plate 120 is preferably made of a hard plastic material, formed by injection molding or blow-molding. It will be appreciated that plate 120 may be made of other materials without departing from the scope of the present invention. Examples of other materials include metal, hard plastics like Hytrel, Pebax, graphite, carbon, or fiberglass. Upper wall 132, and optionally a portion of curved wall 136 may be attached to upper 102 by glue or another adhesive.

As shown in FIG. 1, bottom 104 includes an opening 146 in outsole 108 that is the entrance to bore 122 in rear sole 118. As shown in FIGS. 2 and 3, bore 122 has a central vertical axis and a height extending through outsole 108, through lower wall 134 of plate 120, through midsole 106, and to upper wall 132 of plate 120. As shown in FIG. 2, bore 122 is in air communication with the outside of the shoe through side openings 142 and channels 144 between stiffening members 126. It will be appreciated that bore 122 may be protected from dirt and debris by a transparent wall, or may be restrictively blocked from the outside of the shoe except through opening 146 in bottom 104, and/or through one or more optional openings through heel region 114 of upper 102. Additionally, bore 122 may be adapted to be substantially airtight without departing from the scope of the present invention. For example, substantial air-tightness may be accomplished by eliminating notches 152 of bore 122 and plate slots 170.

When plate 120 has a generally U-shape, a portion of lower wall 134 will preferably form a portion of bore 122. As shown in FIGS. 2 and 3, bore 122 includes a threaded portion 148 formed in lower wall 134 of plate 120. Threaded portion 148 is configured to engage a corresponding threaded portion on platform 150 (FIG. 2) used to move shock-absorbing element 124 within bore 122, as will be described in more detail below. Bore 122 may include notches 152 that generally correspond to channels 144 between stiffening members 126. Threaded portion 148 of bore 122 may extend about one-half the height of bore 122.

Referring to FIGS. 1 and 3, shoe 100 includes an arch bridge 154 under arch region 116 of upper 102. Arch bridge 154 has a lower surface 156 with a portion that is non-ground-engaging. If desired, arch bridge 154 may be made of the same material as plate 118 and may be formed integrally with plate 118.

Figure 6:
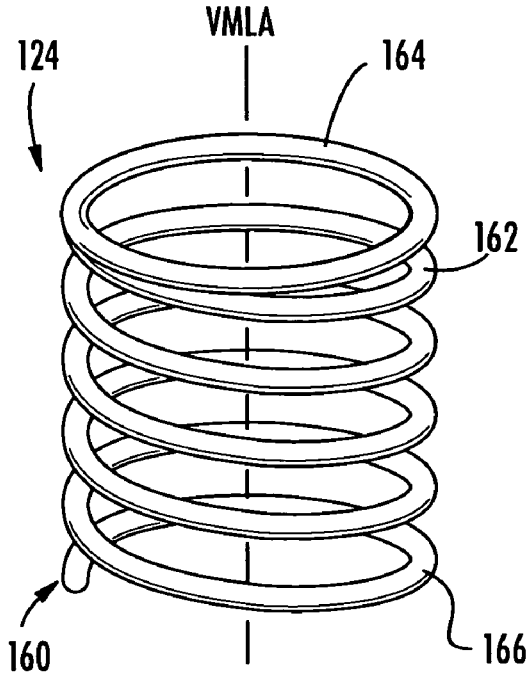
FIG. 6 is a perspective view of the shock-absorbing element of FIG. 2.

Referring to FIGS. 2 and 6, shock-absorbing element 124 is in one preferred embodiment a coil spring 160. Spring 160 has a vertical mid-longitudinal axis (VMLA) and a coil 162 having an upper portion 164 and a lower portion 166. Spring 160 is preferably insertable through bottom 104 of shoe 100. Removability of the spring through the bottom of the shoe, if desired, has several advantages. It allows the moveable plate portions to remain undisturbed, even if they are flexible enough to withstand the bending that would occur through removal through the upper wall of the plate. It would also allow the plate portions to be replaced with a solid plate component if desired. In addition, adjustment of the shock-absorbing element may be easier from outside the shoe.

As shown in FIG. 6, coil 162 has a generally cylindrical shape and a round cross section. It will be appreciated by those of ordinary skill in the art that spring 160 may sized and configured in a way that is optimal for the characteristics of the type of use for which the shoe is manufactured.

Spring 160 may be permanently inserted into bore 122 at the time of manufacture, and thereafter be only adjustable as described herein. Alternatively, bore 122 may be configured such that spring 160 may be removable and/or replaceable by the user after purchase. Bore 122 may be configured such that once spring 160 is inserted into bore 122, the vertical mid-longitudinal axis of spring 160 will preferably be at a perpendicular or at an acute angle to a majority of upper wall 132. The angulation of the plate relative to the vertical mid-longitudinal axis of the spring may facilitate moving the user's foot in a more natural direction of the user's gait cycle after the user's foot contacts the ground.

Figure 5:
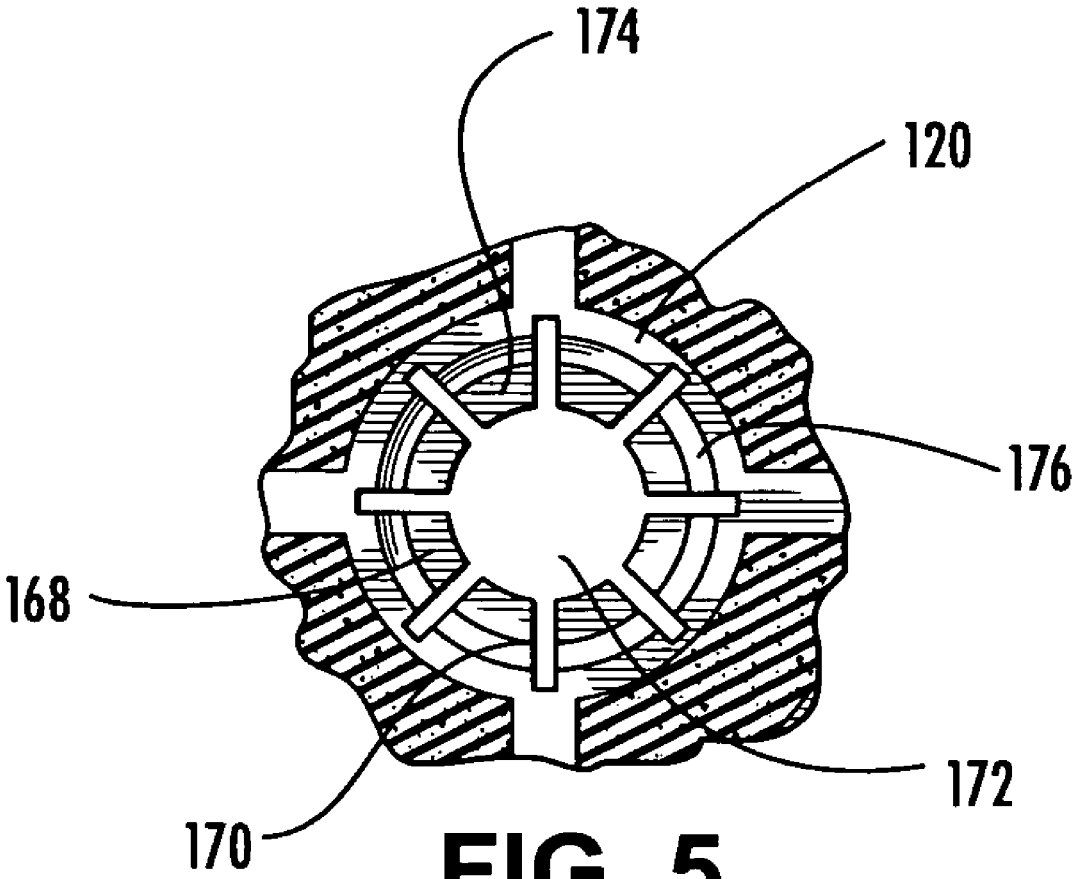
FIG. 5 is a cross sectional view taken along lines 5-5 of FIG. 4 showing a preferred configuration of the plate in the proximity of the shock-absorbing element.

As shown in FIGS. 2 and 5, upper wall 132 of plate 120 includes a plurality of moveable plate portions 168 that are independently moveable relative to one another. Each of moveable plate portions 168 preferably has a general trapezoidal shape and is separated from one another by a plurality of slots 170. Moveable plate portions 168 are preferably arranged around the central vertical longitudinal axis of bore 122. Moveable plate portions 168 together define a single opening 172 having a central longitudinal axis coaxial with the central vertical longitudinal axis of bore 122. Opening 172 is preferably located below heel region 114. It will be appreciated that plate 120 may include a plurality of openings 172 corresponding to a plurality of springs 160.

Each of moveable plate portions 168 has a lower surface 174 oriented away from upper 102. Referring to FIGS. 3A and 5, lower surface 174 of each moveable plate portion 168 preferably includes a groove 176 adapted to receive upper portion 164 of spring 160. It will be appreciated that spring 160 may be fixedly attached to plate 120 by gluing or releasably fixed to plate 120 by configuring lower surface 174 of moveable portions 168 with one or more tabs adapted to retain a portion of spring 160 therein. Additionally, a washer made of a rubber material or other soft material (not shown) may be inserted between grooves 176 and upper portion 164 of spring 160 to permit smoother and quieter compression and decompression of spring 160.

Including individually moveable plate portions above the shock-absorbing element provides additional stability to the shoe, including center of pressure enhancement where a shock-absorbing element is located in the center of the heel region as shown. Additionally, moveable plate portions 168 impart energy stored by the coil spring, and at the same time cushion the top of the spring against the user's heel. The flexibility of moveable plate portions 168 may be adjusted relative to other portions of upper wall 132 by changing the thickness of each moveable plate portion 168, or by modifying the shape of each moveable plate portion. For example, moveable plate portions 168 may be made more flexible by reducing the size of the base along the width of each moveable plate portion, or reducing the thickness along the height of each moveable plate portion.

It will be appreciated that the moveable plate portions may have configurations other than a trapezoidal shape. For example, each moveable plate portion may have a reduced base and an enlarged distal portion relative to the base. Additionally, it is within the scope of the present invention that the moveable plate portions may have different configurations relative to one another or be interconnected by webbing made of the same or different material as the plate. If made of the same material (integrally formed), substantial air tightness may be achieved if desired.

It will further be appreciated that plate 120 may simply have a reduced thickness above bore 122, without openings, to permit plate 120 to be more flexible above the spring, and/or to achieve air tightness.

Spring 160 is preferably selectively adjustable by the user by moving platform 150 against lower portion 166 of spring 160 to move spring 160 from a first relatively uncompressed position, shown in FIG. 3, to a second more compressed position, shown in FIG. 4. Platform 150 includes a central longitudinal axis that preferably is coaxially aligned with the vertical mid-longitudinal axis of spring 160 when adjusting shock-absorbency.

As shown in FIG. 2, platform 150 has an outer perimeter 178 that includes a threaded portion 180 configured to engage corresponding threaded portion 148 of bore 122. Outer perimeter 178 preferably includes notches 182 that are positioned along the perimeter so that as platform 150 is rotated into bore 122, notches 182 may be aligned with notches 152 of bore 122 and channels 144 between stiffening members 126. Platform 150 further preferably includes a projection 184 configured permit a user to move platform 150. It will be appreciated that platform 150 may include an indentation for engaging the leading end of a tool such as a screw driver or a coin. As shown in FIG. 3, platform 150 preferably includes a spring receiving recess 186 adapted to receive lower portion 166 of spring 160. Spring receiving recess 186 preferably has a depth sufficient to accommodate at least one turn of coil 162 of spring 160. A washer made of a rubber material or other soft material (not shown) may be inserted between spring receiving recess 186 and lower portion 166 of spring 160 to permit smoother and quieter compression and decompression of spring 160.

Where threading is used, the user may selectively adjust the shock-absorbency of spring 160 by rotating platform 150 into bore 122 in a direction toward the heel region of upper 102. When a user desires more cushioning or shock-absorbency, platform 150 may be positioned close to the bottom of the shoe as shown in FIG. 3. When a user desires more firmness, the user may rotate platform 150 upward to move and compress spring 160 as shown in FIG. 4. If removability and/or replaceability is a desired feature, spring 160 may be replaced by rotating platform 150 out of an appropriately configured bore 122 and removing spring 160 from bore 122.

In use, the rear sole of the shoe shown in FIGS. 1-4 contacts the ground during the downward stroke of the gait cycle of the user of the shoe. The user's weight is channeled through the user's heel and into the approximate center of the heel region of the shoe below the calcaneus of the user of the shoe. The central location of opening 172 (FIGS. 2 and 5) and the flexibility of moveable plate portions 168 facilitate focusing the downward force exerted by the user into spring 160. Spring 160 compresses, storing the energy expended during the foot strike of the user. As the user's foot lifts off the ground, spring 160 releases the stored energy, helping to propel the user's foot off the ground. The angulation between upper wall 132 of plate 120 and the vertical mid-longitudinal axis of spring 160 facilitates propelling the user's foot in the natural direction intended by the user.

The greater flexibility of moveable plate portions 168 relative to other portions of plate 120 and the placement of stiffening members 126 around spring 160 provide additional lateral support and help focus the downward force into spring 160.

Threaded portion 148 of bore 122 preferably extends a height sufficient to permit a full range of shock-absorbency. The height of the threaded portion of bore 122 preferably extends at least 25% to 50% more than the height of threaded portion 180 of outer perimeter 178 of platform 150. It will be appreciated that the height of the threaded portion of bore 122 may be increased or decreased without departing from the scope of the present invention. Bore 122 may be configured to permit platform 150 to move above the height of the threaded portion of bore 122 as shown in FIG. 4.

It is contemplated that the present invention includes a method for adjusting the shock absorbing ability of the shoe, including providing a shock-absorbing element such as a spring moveable into a plurality of positions to adjust the amount of shock absorbed by the spring. The movement of the spring may be accomplished without removing the spring from the shoe and without the user rotating the spring itself. The method may include rotating or suppressing a member such as platform 150 so as to compress the spring and thereby selectively adjust shock absorption. The method may further include insertion and removal of the shock-absorbing element from above or beneath the shoe. The method may further include obtaining the intended user's physical characteristics and adjusting the shock-absorbing element to a selected level based on the data obtained about the intended user.

It will be appreciated and understood by those of ordinary skill in the art that the shock-absorbing element may have a configuration other than a spring. Additionally, it is envisaged that where the shock-absorbing element is a spring, the spring may be one of several types of springs such as, but not limited to, a mechanical spring, a disc spring, a Belleville spring, a spiral or coil spring, or a coiled leaf spring. The shock-absorbing element may include a plurality of springs stacked one upon another.

FIGS. 7 to 13 show other preferred embodiments of shock-absorbing elements useable with the present invention.

Figure 7:
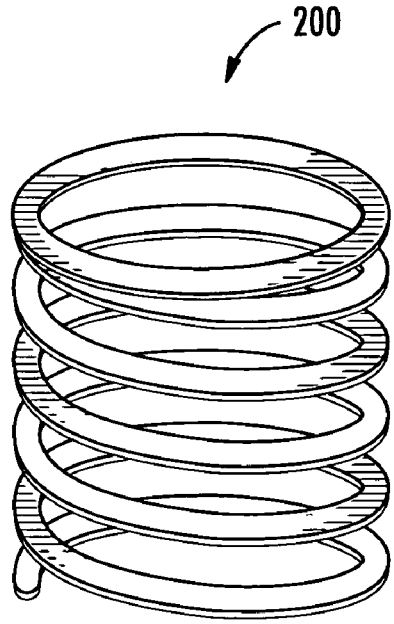
FIG. 7 is a perspective view of a shock-absorbing element having a flat, cylindrical configuration in accordance with another preferred embodiment of the present invention.

FIG. 7 shows another preferred embodiment of a coil spring 200 which is similar to spring 160, except that the coil has a generally flat cross section. Both of the springs shown in FIGS. 6 and 7 are untapered toward the top.

Figure 8:
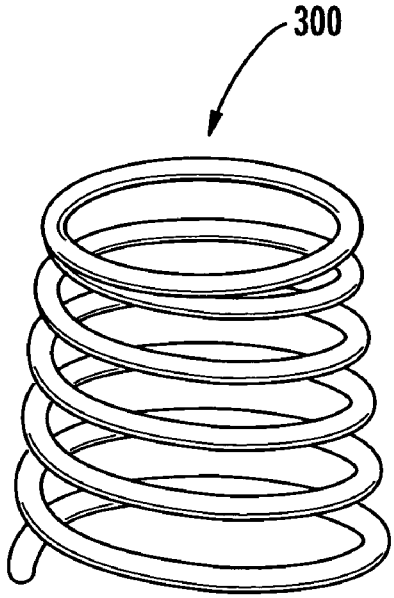
FIG. 8 is a perspective view of a shock-absorbing element having a rounded, conical configuration in accordance with another preferred embodiment of the present invention.

The shock-absorbing element of FIG. 8 is a tapered coil spring 300 with a substantially round cross-section.

Figure 9:
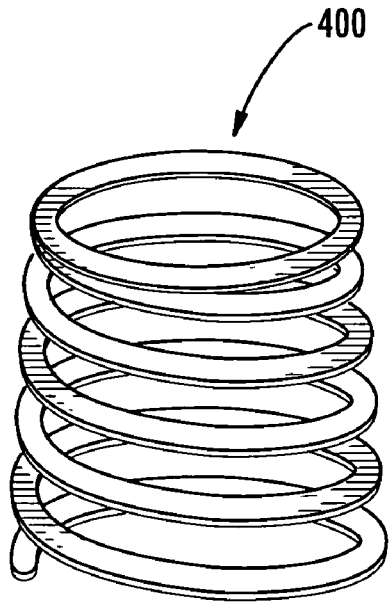
FIG. 9 is a perspective view of a shock-absorbing element having a flat, conical configuration in accordance with another preferred embodiment of the present invention.

The shock-absorbing element of FIG. 9 is a tapered coil spring 400 with a flattened-out cross-section.

Figure 10:
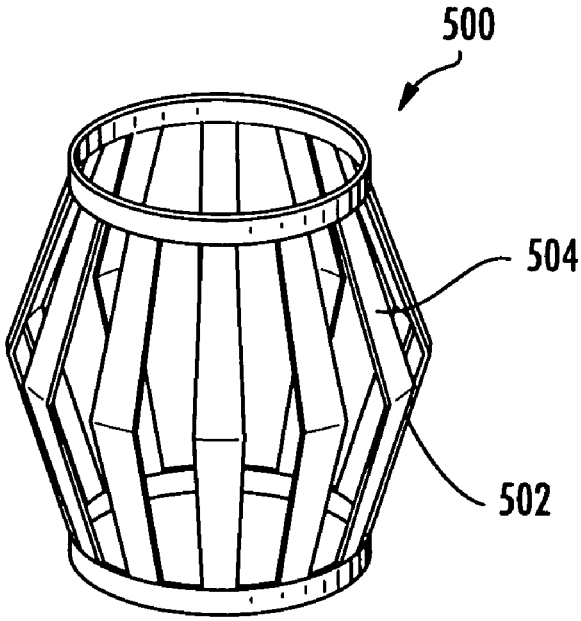
FIG. 10 is a perspective view of a shock-absorbing element having a side portion which is bent outwardly in accordance with another preferred embodiment of the present invention.

The shock-absorbing element of FIG. 10 is a "basket"-shaped shock-absorbing element 500 with a bulge 502 outwardly at sidewalls 504.

Figure 11:
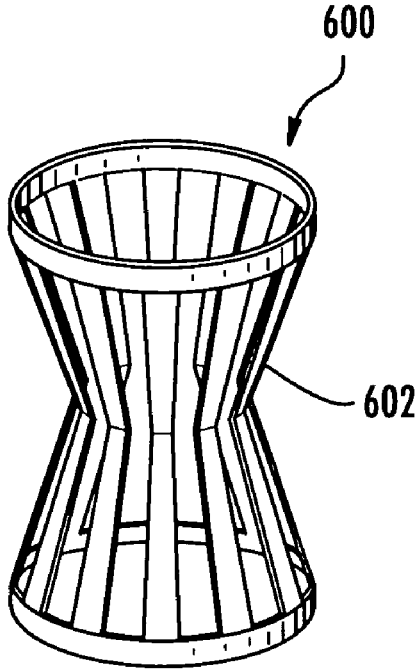
FIG. 11 is a perspective view of a shock-absorbing element having a side portion which is bent inwardly in accordance with another preferred embodiment of the present invention.

The shock-absorbing element of FIG. 11 is an "inverted basket" shock-absorbing element 600 with sidewalls 602 extending inwardly.

Figure 12:
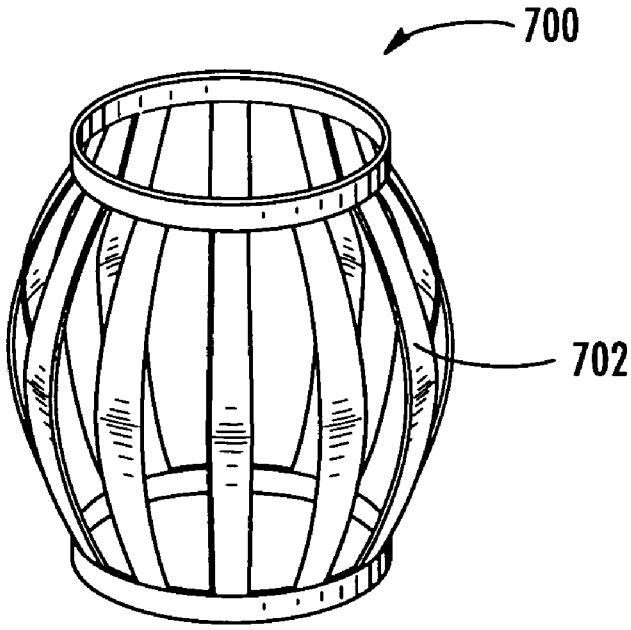
FIG. 12 is a perspective view of a shock-absorbing element having a side portion which is bowed outwardly in accordance with another preferred embodiment of the present invention.

Shock-absorbing element 700 of FIG. 12 is like the shock-absorbing element of FIG. 10, but with a more rounded shape to the outwardly bulging sidewalls 702.

Figure 13:
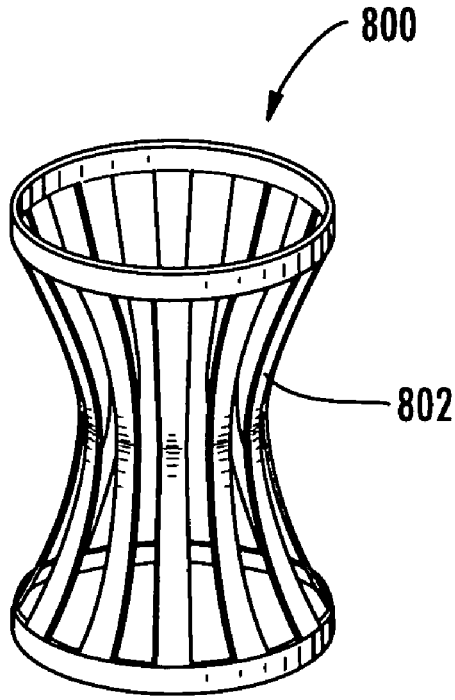
FIG. 13 is a perspective view of a shock-absorbing element having a side portion which is bowed inwardly in accordance with another preferred embodiment of the present invention.

Shock-absorbing element 800 of FIG. 13 is like the shock-absorbing element of FIG. 11, but with a similarly rounded shape to the inwardly extending sidewalls 802.

It will be appreciated that the shock-absorbing elements described herein may be made of a wide range of materials, including metal, hard plastics like Hytrel or Pebax, graphite, graphite composite, carbon, or fiberglass. Combinations of these materials could also be used. For example, the rings at the top and bottom of the shock-absorbing elements shown in FIGS. 10, 11, 12, and 13 may be made of a plastic material and the sidewalls may made of graphite composite. In the case of combination structures, slots (not shown) could be placed in the plastic rings to receive the graphite composite sidewall elements, or elements made of other types of plastic, fiberglass or different graphite material.

It will be appreciated that other embodiments of the present invention are contemplated and fall within the scope of the present invention. For example, FIGS. 1 and 2 show a single shock-absorbing element in the rear sole. It will be appreciated by those of ordinary skill in the art that one or more shock-absorbing elements may be utilized and positioned at locations not limited to the rear sole.

The plate and the shock-absorbing element may be made of the same material and integrally formed to one another. For example, upper portion 164 of spring 160 may be integrally formed with moveable plate portions 168.

As another option, the spring may be integrally connected to the platform so that rotating the platform into the bore will cause rotation of the spring, and a resultant tightening of the spring, into the shoe. Alternatively, the top of the platform may be configured so that as the platform is rotated into the bore, the spring does not rotate with the platform, or does not rotate to any significant degree.

The platform need not have a threaded perimeter. For example, instead of a threaded platform shown in FIGS. 1 and 2, a rotatable side wheel may be incorporated on one or both sides of the shoe (like a Chapstick container). This would have the advantage of being more resistant to road debris. Further, a spring lock ratchet mechanism may be internally incorporated on either the threaded platform or the threads into which the platform is screwed so that as platform 124 is rotated, the degree of compression is "locked" into place. The spring lock may be releasable or reversible (like a power drill) so that reverse rotation is permitted. As yet another option (not shown), the platform may be permanently fixed to the bottom of the bore, a rotatable side wheel mechanism attached at the top of the bore, and compression of the spring accomplished by turning the rotatable side wheel mechanism from within the shoe, with the sock liner (if any) removed or pulled back.

As another option, the spring need not be compressed by rotating a platform against it. For example, a user may pinch a pair of projections on either side of the shoe to lift a platform below the spring upwardly in a ratchet-like manner.

The platform, or a portion thereof, may be transparent if so desired so that a user may readily ascertain the level of compression of the spring or inspect the cleanliness of the spring. The sidewalls of spring bore 122 may also include markings or color changes to assist the user in determining the proper amount of compression so that the user may compress the spring to a selected compression level based on the user's preference or physical characteristics such as weight. This has the advantage of the shoe being custom-tailorable to the individual user in a precise manner.

If desired, a protective cover may be included that engages either or both the platform and sidewall of the bore to protect the bore from the entry of dirt and debris. The cover may be made of the same material as the outsole. The cover may be adapted to peel away from the platform or disengage from the bottom of the bore by prying it from the bore with a tool such as a screw driver.

The bore may be adapted so that the spring is insertable from the top (whether it is then adjustable from beneath the shoe or from inside the shoe). For example, plate 120 may have an opening adapted to accommodate the maximum diameter of the spring so that the spring may be inserted from inside the shoe through the heel region of the upper. A plate cover may be engaged with the plate opening to secure the spring in the bore. The plate cover may have holes and/or a lesser thickness to be more flexible than other areas of the plate. The cover may engage the plate by screwing into the plate, snapping into the plate, or inserting and rotating the cover into the plate using a combination of tabs and grooves.

The shoe may have a plate portion that extends up to the full length of the shoe. Upper and lower walls 132, 134 of plate 120 shown in FIG. 3 need not be joined by curved wall 136, but may exist as angled plate portions or parallel plate portions. Additionally, the shoe may include only a single plate wall if so desired.

The present invention provides for one or more of the following advantages. The shock-absorbing element may be replaceable (if removeability and/or replaceability is a desired feature) from a position that does not compromise the stability of the shoe. The shoe has a configuration that provides enhanced stability. The shock-absorbency may be selectively adjustable without replacing or disassembling the shoe. The over-all weight of the shoe may be reduced as a result of a reduction in the amount of material used to make the midsole. The costs of manufacturing are reduced in part due to the reduction of materials required to construct the midsole and plate support. These and other advantages of the present invention will be apparent from review of the following specification and the accompanying drawings.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A shoe comprising:

an upper, the upper having a heel region, the heel region having a vertical central axis and an interior portion;

an upper wall located beneath at least a portion of the heel region of the upper, at least a portion of the upper wall being in a plane generally perpendicular to the vertical central axis of the heel region, the upper wall having a peripheral portion and an interior portion, wherein the interior portion of the upper wall has a plurality of movable portions, the interior portion capable of being deflected relative to the peripheral portion in a direction approximately parallel with the vertical central axis of the heel region;

a bottom surface, at least a portion of which is ground-engaging;

a spring having a vertical mid-longitudinal axis, at least a portion of the spring being located between at least a portion of the interior portion of the upper wall and at least a portion of the bottom surface, the spring capable of being compressed and decompressed in communication with the deflection of the interior portion of the upper wall in a direction parallel with the mid-longitudinal axis of the spring; and a platform located beneath at least a portion of the spring, at least a portion of the platform being in a plane approximately parallel with at least a portion of the upper wall, the platform capable of being moved by the wearer of the shoe along a line approximately parallel with the vertical central axis of the heel region of the upper from a first position to a second position.

2. The shoe of claim 1, wherein the spring is the only spring located beneath the heel region of the upper.

3. The shoe of claim 1, wherein the vertical mid-longitudinal axis of the spring is approximately parallel with the vertical central axis of the heel region of the upper.

4. The shoe of claim 3, wherein the vertical mid-longitudinal axis of the spring is approximately coincidental with the vertical central axis of the heel region of the upper.

5. The shoe of claim 1, wherein the platform has an outer perimeter that includes a threaded portion.

6. The shoe of claim 5, wherein the threaded portion of the outer perimeter of the platform is capable of mating with a threaded portion of an element of the shoe proximate the bottom surface of the shoe.

7. The shoe of claim 6, wherein the element includes a lower wall located at least in part beneath at least a portion of the interior portion of the upper wall, the interior portion of the lower wall containing an opening, the opening being defined at least in part by the threaded portion of the element.

8. The shoe of claim 6, wherein the threaded portions are the only threaded portions of the shoe proximate any portion of the spring.

9. The shoe of claim 1, wherein the spring is adapted to absorb shock independent of air or fluid pressure.

10. The shoe of claim 1, wherein the spring is a mechanical spring.

11. The shoe of claim 1, wherein the platform has a central longitudinal axis, the central longitudinal axis of the platform being generally coaxial with the vertical mid-longitudinal axis of the spring.

12. The shoe of claim 1, wherein the platform is adapted to rotate to move the spring from the first position to the second position.

13. The shoe of claim 1, wherein the platform is removable from the shoe through an opening in the bottom surface of the shoe to provide access to the spring.

14. The shoe of claim 13, wherein the spring is removable through the opening in the bottom surface of the shoe following removal of the platform.

15. The shoe of claim 1, wherein the platform is adapted to move independently of the spring.

16. The shoe of claim 1, wherein the spring has a generally cylindrical profile.

17. The shoe of claim 1, wherein the spring is a coil spring.

18. The shoe of claim 1, wherein the interior portion of the upper wall has a plurality of independently movable portions.

19. The shoe of claim 18, wherein the independently movable portions surround the vertical central axis of the heel region of the upper.

20. The shoe, of claim 18, wherein the independently movable portions are separated by slots therebetween.

21. The shoe of claim 18, wherein the independently movable portions are Interconnected by webbing.

22. The shoe of claim 18 wherein at least one of the independently movable portions of the interior portion of the upper wall has varying degrees of thickness.

23. The shoe of claim 18, wherein each of the independently movable portions of the interior portion of the upper wall has a lower surface, the lower surface of each of the movable portions being oriented away from the heel region of the upper.

24. The shoe of claim 23, wherein the lower surface of at least one of the independently movable portions includes a groove adapted to receive an upper portion of the spring.

25. The shoe of claim 24, wherein a soft material is inserted between the groove and the upper portion of the spring to permit smoother compression and decompression of the spring.

26. The shoe of claim 24, wherein a soft material is inserted between at least a portion of the platform and a lower portion of the spring to permit smoother compression and decompression of the spring.

27. The shoe of claim 18, wherein at least one of the independently movable portions has a generally trapezoidal shape.

28. The shoe of claim 1, wherein the interior portion of the upper wall has an opening therethrough.

29. The shoe of claim 28, wherein the spring is in air communication with the interior portion of the heel region of the upper through the opening in the interior portion of the upper wall.

30. The shoe of claim 1, wherein the spring is in air communication with the outside of the shoe.

31. The shoe of claim 28, wherein the vertical central axis of the heel region of the upper passes through the opening.

32. The shoe of claim 31, wherein the vertical central axis of the heel region of the upper passes through the approximate center of the opening.

33. The shoe of claim 1, wherein a cross-section of the spring is round in shape.

34. The shoe of claim 1, wherein a cross-section of the spring has at least one substantially planar surface.

35. The shoe of claim 1, wherein the platform is adapted to secure the spring between at least a portion of the platform and the interior portion of the upper wall.

36. The shoe of claim 1, wherein the platform is adapted to cause a change in the amount of tension in the spring.

* * * * *